United States Patent [19]

Selz

[11] Patent Number: 4,693,410

[45] Date of Patent: Sep. 15, 1987

[54] DRINKING CUP WITH CLOSURE FOR OPEN BOTTLES AND/OR CANS

[75] Inventor: Aloiz Selz, Freiburg, Fed. Rep. of Germany

[73] Assignee: Surculus AG, Vaduz, Liechtenstein

[21] Appl. No.: 809,059

[22] Filed: Dec. 12, 1985

Related U.S. Application Data

[63] Continuation-in-part of Ser. No. 561,198, Dec. 14, 1983, abandoned.

[30] Foreign Application Priority Data

Jan. 28, 1983 [DE] Fed. Rep. of Germany ..... 3302842
Nov. 12, 1983 [EP] European Pat. Off. ..... 83111317.0

[51] Int. Cl.[4] ..... B65D 41/26; B65D 41/50; B65D 41/58; A47G 19/22

[52] U.S. Cl. ..... 229/1.5 B; 215/228; 215/321; 215/100 R; 220/90.2; 220/90.4; 220/209; 220/212; 220/306

[58] Field of Search ..... 229/1.5 B; 215/228, 215/100 R; 220/90.2, 90.4, 90.6, 209, 306, 307, 212; 215/321

[56] References Cited

U.S. PATENT DOCUMENTS

| | | | |
|---|---|---|---|
| 377,483 | 2/1888 | Furstenwarther | 215/228 |
| 973,085 | 10/1910 | Strause | 215/100.5 |
| 1,173,553 | 2/1916 | Burdick | 215/228 |
| 1,583,019 | 5/1926 | Simmons | 215/321 |
| 2,107,309 | 2/1938 | Smith | 215/321 |
| 2,284,625 | 6/1942 | Smith | 220/90.6 |
| 2,577,030 | 12/1951 | Neuman | 220/100 R |
| 2,778,521 | 1/1957 | Casle | 215/228 |
| 3,159,298 | 12/1964 | Saw | 215/228 |
| 3,262,612 | 7/1966 | Tabor | 220/307 |
| 3,381,838 | 7/1968 | McClain | 215/100 R |
| 3,527,376 | 9/1970 | Young | 220/209 |
| 4,098,439 | 7/1978 | Blow . | |
| 4,125,218 | 11/1978 | DeBoer | 229/1.5 B |

FOREIGN PATENT DOCUMENTS

| | | | |
|---|---|---|---|
| 1928945 | 10/1970 | Fed. Rep. of Germany . | |
| 2020488 | 11/1971 | Fed. Rep. of Germany . | |
| 2042403 | 3/1972 | Fed. Rep. of Germany | 215/228 |
| 2123491 | 12/1972 | Fed. Rep. of Germany | 215/228 |
| 2641874 | 3/1978 | Fed. Rep. of Germany | 220/90.4 |
| 1164763 | 10/1958 | France | 215/228 |
| 1191831 | 10/1959 | France | 215/321 |
| 2324531 | 4/1977 | France | 215/321 |
| 560632 | 4/1975 | Switzerland | 215/228 |
| 364528 | 12/1931 | United Kingdom . | |

*Primary Examiner*—George E. Lowrance
*Attorney, Agent, or Firm*—Peter K. Kontler

[57] ABSTRACT

A plastic drinking cup which is integrally connected with one or more elastic closures for the open ends of bottles and/or openings in the top walls of metallic or plastic cans. A closure can be provided at the inner side or at the outer side of the bottom wall of the cup, at the inner side or at the outer side of the tubular wall of the cup, or at the inner side of a transverse wall which is inwardly adjacent to the bottom wall. The closure can constitute an integral or a separable part of the cup, and the latter can be provided with a relief valve to allow for a reduction of pressure in the interior of a bottle or can whose open end or opening is sealed by the closure. The cup can carry two closures, one with a concave internal surface to sealingly engage with and to swivel relative to the partly spherical external surface of a bottle and the other for a can. Each closure can be manually applied to or disengaged from the bottle or can.

57 Claims, 27 Drawing Figures

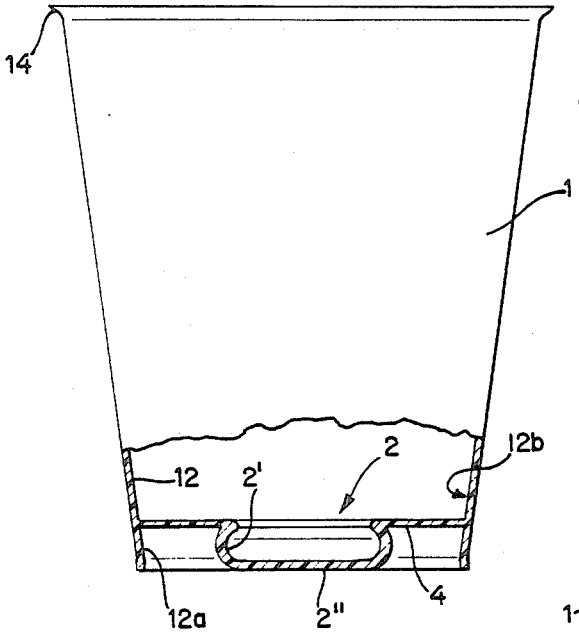
Fig. 1
Fig. 2
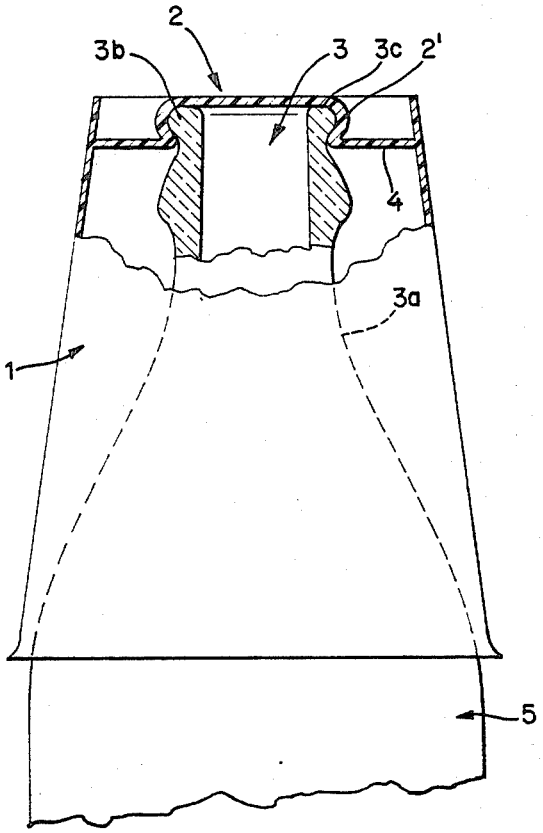
Fig. 4
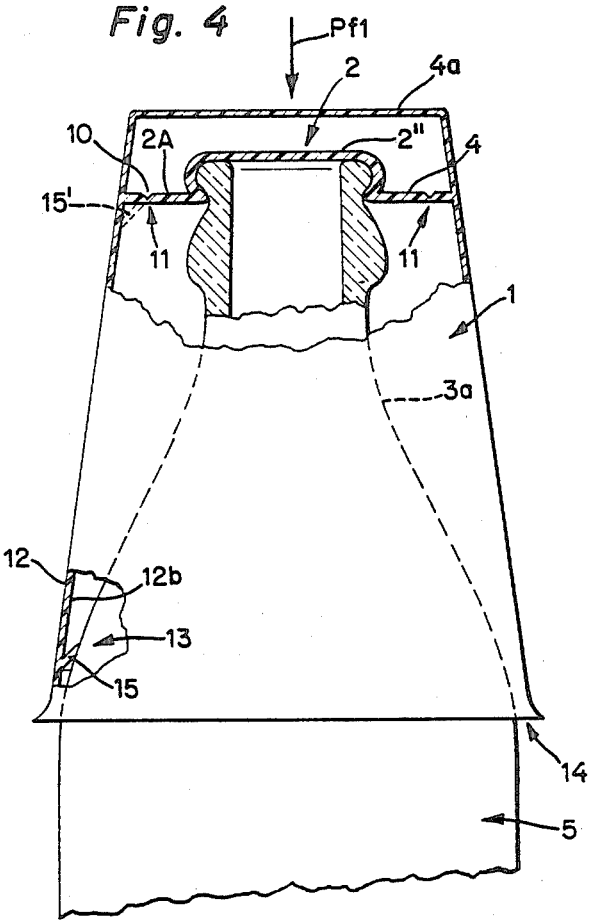
Fig. 3
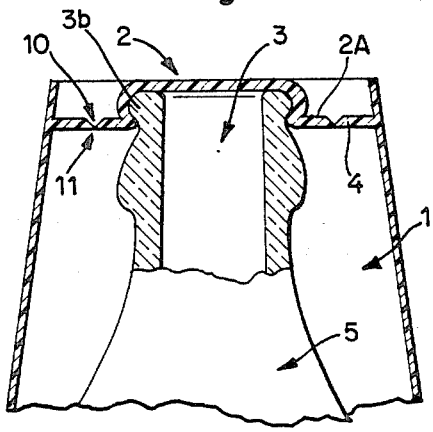

Fig. 11
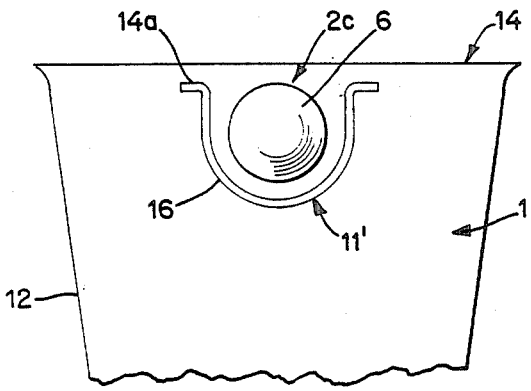
Fig. 5
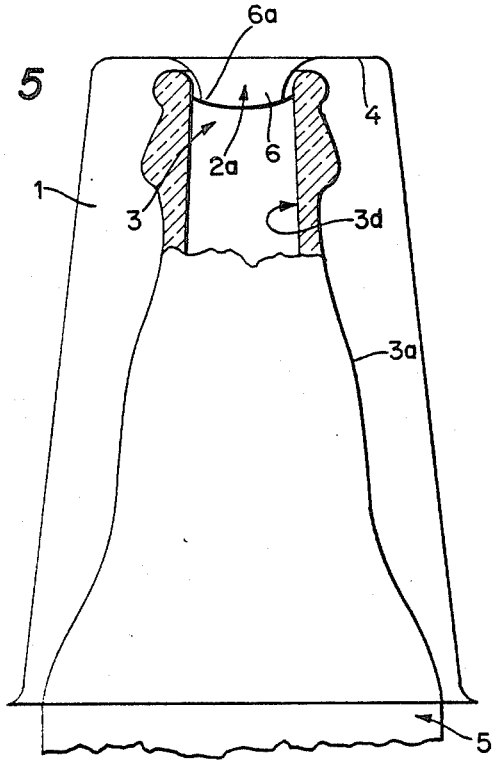
Fig. 6
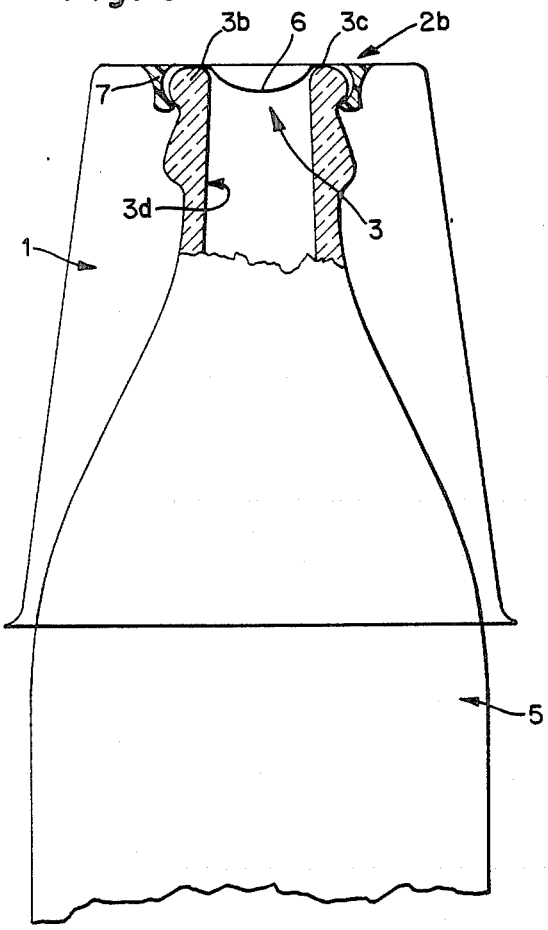
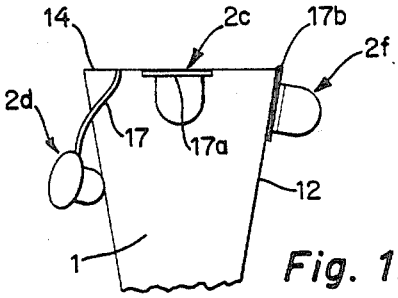
Fig. 12
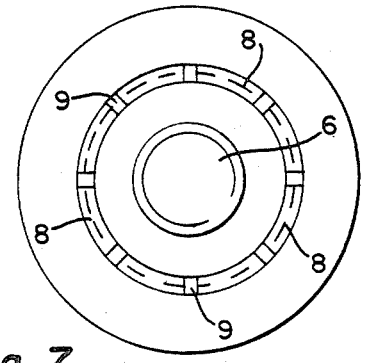
Fig. 7

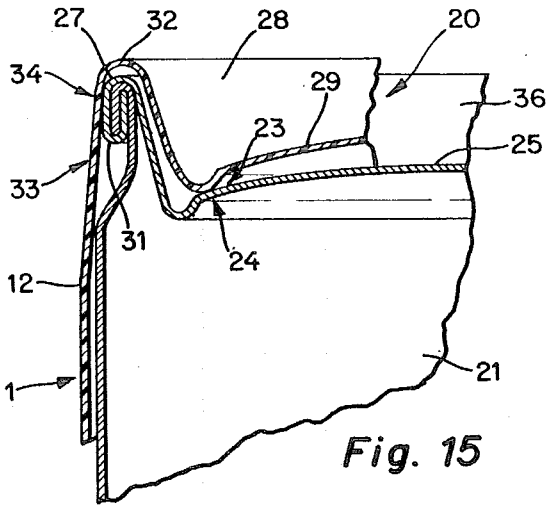
Fig. 15
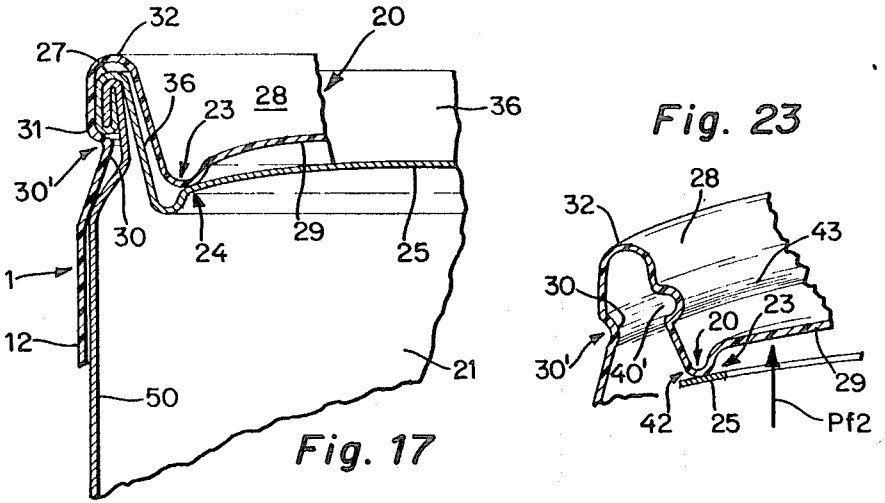
Fig. 17
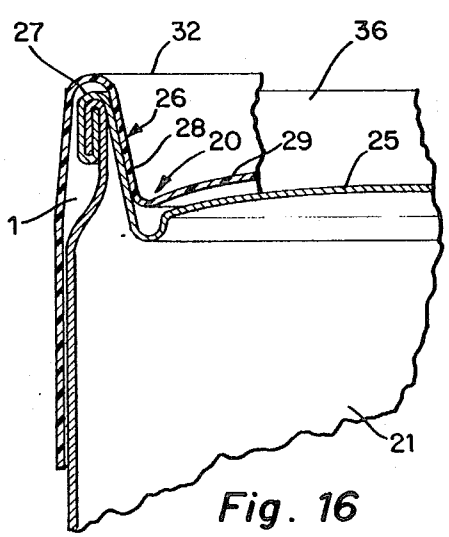
Fig. 16
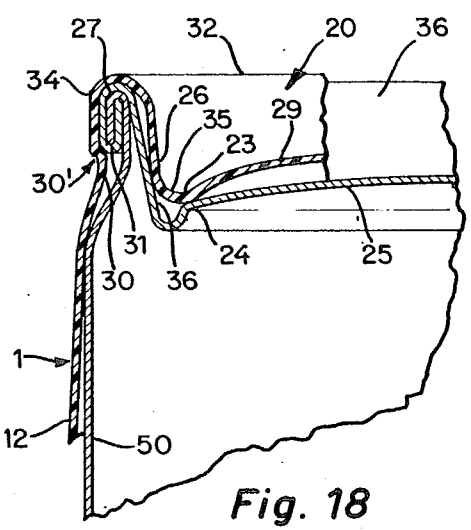
Fig. 18
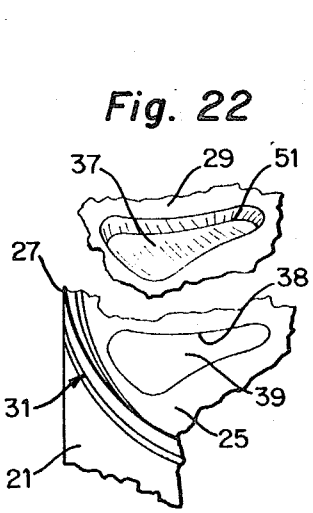
Fig. 22
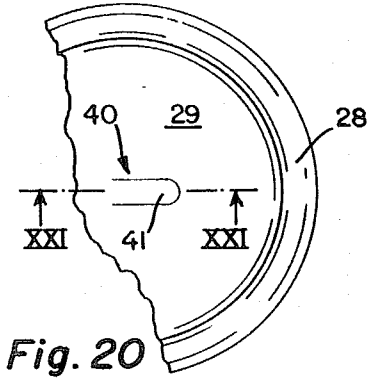
Fig. 20
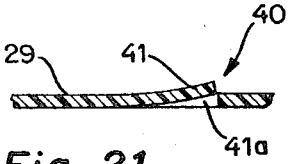
Fig. 21
Fig. 23

DRINKING CUP WITH CLOSURE FOR OPEN BOTTLES AND/OR CANS

CROSS-REFERENCE TO RELATED CASE

This is a continuation-in-part of the copending patent application Ser. No. 561,198 filed Dec. 14, 1983, and now abandoned.

BACKGROUND OF THE INVENTION

The present invention relates to receptacles which can be used as drinking cups. More particularly, the invention relates to improvements in receptacles which can be used as dispensable drinking cups.

It is well known to make drinking cups of a suitable synthetic plastic material or of paper which is reinforced (impregnated) with plastic material to improve its liquid-retaining characteristics. Such drinking cups can be used by campers, in offices, on boats, trains or airplanes for distribution with opened bottles or cans containing alcoholic beverages or soft drinks, in mess halls, at sports events, at parties, political rallies and/or on analogous occasions. It is also known to make relatively sturdy plastic cups which can be reused after cleaning and are sufficiently stable to withstand mistreatment by children or by careless adults.

In many instances, a cup is served or purchased together with a freshly opened bottle or with an openable or opened can. The purchaser or another recipient pours the beverage into the cup and normally disposes of the bottle or can, as well as the cup, when the bottle or can is empty. However, if the contents of the bottle or can are not consumed in their entirety, the purchaser or recipient will often wish to conserve the remaining liquid and to shield the opening or open top against entry of insects, dust and/or other foreign matter. As a rule, a person manipulating the cup places the cup upside down on top of the bottle or can so that the neck of the bottle or a certain portion of the upper part of the can is concealed in the interior of the inverted cup. This does not prevent spillage if the bottle or can is accidentally overturned. If the bottle was originally sealed by a crown cork or the like, which must be removed by resorting to a suitable tool, or if access must be gained to the contents by removing an integral portion of the top wall of a metallic or plastic can, the opening of the can cannot be resealed by restoring the original seal and the bottle cannot be resealed by resorting to the once-removed crown cork. Therefore, a can is simply emptied because there is no possibility of preventing spillage in response to tilting or overturning. As far as a bottle is concerned, it is necessary to resort to a cork or to a specially designed reusable cap in order to prevent spillage in response to tilting or overturning.

The placing of a cup in inverted position over the neck of an open bottle or over the top portion of an opened can is a stopgap measure which, as already mentioned above, can prevent entry of insects, dust and/or other foreign matter but does not result in resealing of the bottle or can. Moreover, and if the bottle or can contains a carbonated beverage, the gaseous ingredients escape regardless of whether or not such container is partially confined in an inverted cup. In other words, the beverage deteriorates very rapidly and must be discarded if it is not consumed within a short interval of time subsequent to opening of the bottle or can.

A drawback of separate corks or reusable caps for bottles is that they contribute to the cost and also that they are likely to be lost or misplaced. Moreover, it is practically impossible to furnish an adequate number of corks or reusable caps for each bottle of soft drink or beer which is consumed by spectators attending a large sports event, by the participants of a convention or by the visitors in a natural park or the like. Still further, spent bottles and cups are discarded together with the spare corks or reusable caps to thus further contribute to the littering problem. In addition, a specially designed reusable cap must be furnished with instructions on how to apply it to and how to detach it from the open top of a bottle which again contributes to the combined cost of the bottled beverage and a drinking cup.

OBJECTS AND SUMMARY OF THE INVENTION

An object of the invention is to provide a novel and improved vessel which can perform several functions, particularly those of a drinking cup and a closure for bottles, cans or analogous containers.

Another object of the invention is to provide a vessel which is not or need not be more expensive than an ordinary drinking cup.

A further object of the invention is to provide a vessel which can be used as a drinking cup as well as a closure for several different types of open containers.

An additional object of the invention is to provide a vessel which can be converted into a discrete cup and a discrete closure for bottles or the like.

Still another object of the invention is to provide a vessel which occupies little room, which is or can be designed in such a way that the closure or closures cannot be misplaced or lost, and which can be manipulated by children or other unskilled persons with no training.

A further object of the invention is to provide a vessel which can adequately seal a container for carbonated or non-carbonated beverages, which can be used as a means for sealing of oddly or regularly shaped containers, and which can be furnished in a wide variety of eye-pleasing shapes as well as in any practical size.

Another object of the invention is to provide a combined cup and closure which is designed in such a way that it adds little to the bulk of the container which is to be resealed by the closure.

An additional object of the invention is to provide a combined cup and closure which need not be manipulated by resorting to any tools and whose closure can be applied or removed with a minimum of effort, either once or more than once.

Another object of the invention is to provide a combined cup and closure which is or can be constructed and assembled in such a way that it occupies little room when stored with a large number of identical devices, which is highly unlikely to injure the user, and which can be designed to furnish an accurately selected sealing action.

The invention is embodied in a multiple-purpose vessel which comprises a drinking cup, particularly a disposable cup, and at least one closure which is sealingly connectable with an open container, such as a bottle or a can, to prevent spillage of the contents of the container. At least the cup preferably contains or consists of a suitable synthetic plastic material, and the cup is preferably integral with the closure.

The closure can be disposed in the interior of the cup, for example, in the region of the bottom wall of the cup. Alternatively, the closure can be located externally of the cup, for example, in the region of the bottom wall or in the region of the rim. The arrangement is preferably such that the closure is at least slightly elastic and is manually applicable to and/or detachable from the container; for example, the closure can comprise or constitute a means for attachment to a bottle or can by snap action. To this end, a circumferentially complete elastic socket of the closure can be provided with a concave internal surface which is complementary to the partly spherical external surface at the open end of a bottle or a like container.

The closure can comprise a cap which can be caused to overlie and surround the open end portion of a bottle and/or a cork which is sealingly receivable in the open end portion of a bottle (at least a portion of such cork preferably constitutes a cone to facilitate its insertion into and to enhance its sealing action in the open end portion of the bottle). A closure which includes a cork can further comprise a socket which serves to at least partially surround the open end portion which is sealed by the cork; such socket can constitute a circumferentially complete body or it can comprise several prongs which are separated from each other by slots.

The vessel can comprise means for integrally but separably connecting the closure to the cup. Such connecting means can comprise a membrane, a weakened portion of the cup or an otherwise breakable joint between the cup and the closure. For example, the closure can be disposed substantially centrally of the bottom wall of the cup, and the connecting means can comprise a breakable joint between the bottom wall and the closure. The joint is preferably a fluidtight joint. If the cup has a twin bottom wall (i.e., an outer bottom wall and an inner bottom wall or transverse wall which latter is spaced apart from the outer bottom wall and from the rim of the cup), the closure can be made integral with the transverse wall in such a way that the joint between the closure and the transverse wall can be broken, when necessary, in order to enable the closure to seal a bottle or can while the cup is being disposed of or used for reception of liquid from another container. The closure preferably extends from the transverse wall in a direction toward the rim of the cup.

Alternatively, the closure can constitute an integral part of the tubular wall of the cup, namely, of the wall which extends between the bottom wall and the rim. Means (e.g., a membrane or a filamentous connector) can be provided for connecting at least a portion of the closure to such tubular wall. The connecting means can include a web which is integral with the tubular wall and with a portion of the closure (the remaining portion of the closure can be surrounded by a slot, slit or a breakable membrane). The connecting means (e.g., the aforementioned filamentous connecting element) preferably consists of a suitable synthetic plastic material. Such connecting means is or can be breakable to allow for complete separation of the closure from the cup. Instead of relying on a filamentous connecting element as a means for movably connecting the closure to the cup, it is also possible to resort to a hinge (e.g., to the aforementioned web which can be said to constitute a rudimentary hinge serving to pivotally connect the closure and the cup to one another).

In accordance with an additional feature of the invention, the vessel can comprise means for intercepting remnants of liquid which accumulate on the bottom wall and tend to flow along the internal surface of the tubular wall toward and beyond the rim when the cup is held in inverted position, e.g., by being placed onto the open top of a bottle so that a closure at the inner side of the bottom wall or on the aforementioned transverse wall seals the open end portion of the bottle. The intercepting means can comprise one or more annular troughs which extend inwardly from the internal surface of the tubular wall and are or can be adjacent to the rim. For example, each trough can comprise an annular inner wall which is integral with and slopes away from the internal surface in a direction toward the bottom wall of the cup.

If the closure is located externally of the cup, it can be designed to constitute or resemble a handle or handgrip which facilitates manipulation of the cup. The closure can comprise a conventional stopper, e.g., a crown cork.

If the closure is provided at the inner side of or close to the bottom wall in the interior of the cup, the entire cup or at least that portion which is adjacent to and includes the bottom wall preferably consists of a light-transmitting (transparent or translucent) material to facilitate application of the closure to the open end portion of a container.

If the container is used for storage of carbonated liquids or any other liquids which can cause a rise of pressure in the interior of the container, the vessel preferably further comprises at least one relief valve which opens when the closure seals the open end of the container and the pressure in the container rises above a predetermined value. The valve can be of the type which exhibits a tendency to close so that it automatically reseals the container when the pressure in the container drops below the predetermined maximum permissible value. For example, the valve can be provided in or on the bottom wall of the cup and can include a flap constituting an integral part of the bottom wall and a slit surrounding the flap. Alternatively, the flap can have a portion which is integral with the bottom wall and the latter can comprise a breakable connection (e.g., a membrane) between the remainder of the flap and the bottom wall (such connection breaks, in part or entirely, when the pressure in the container rises above the predetermined value).

The closure can be a composite closure including discrete first and second closures one of which can be used to seal the open end portion of a bottle and the other of which can be used to seal the open end of a different container, particularly a metallic or plastic can for beer, wine, soft drinks and the like. Such discrete closures can be provided on the bottom wall of the cup, one at the outer side and the other at the inner side of the bottom wall, i.e., one of the discrete closures can be located in the interior and the other can be installed externally of the cup.

That end portion of the tubular wall of the cup which is remote from the rim can be used as a circumferentially complete annular leg for deposition of the cup on the supporting surface of a table or the like. In other words, the bottom wall of the cup can be disposed inwardly of that end portion of the tubular wall which is remote from the rim.

If the closure is to be used for separably sealing an opened can whose top wall portion has an opening and is surrounded by a marginal portion of the can, the closure preferably comprises one or more annular seals which are movable into and out of fluidtight sealing engagement with at least one portion of the can, i.e., with the marginal portion and/or with the top wall portion. For example, the annular seal can form part of the tubular wall of the cup so that it engages the external surface of the marginal portion of the can when the cup is placed onto the can upside down so that the top wall portion and the marginal portion of the can are confined in the interior of the cup. Alternatively, or in addition to the just outlined design of the cup, an annular seal of the closure can be caused to fluidtightly engage the peripheral portion of the top wall portion of the can; such annular seal can be provided on or can form part of the bottom wall of the cup and it engages the peripheral portion of the top wall portion when the cup is placed (upside down) onto the can so that it surrounds and confines the top wall portion and the marginal portion of the can. Furthermore, the inner side of the bottom wall of the cup can be provided with a projection which sealingly fits into the opening of the top wall portion of the can and/or which sealingly engages the exposed side of the top wall portion around the opening. Such bottom wall preferably consists of a light-transmitting material to facilitate the insertion of the projection into or proper orientation of the projection relative to the opening in the top wall portion of the can. If the annular seal (or one of the annular seals) is formed by the tubular wall of the cup, that portion of the tubular wall which constitutes the seal (namely, the portion adjacent to the bottom wall) can have a frustoconical shape to sealingly engage a complementary external surface of the marginal portion of the can.

The cup can comprise at least one stop which engages an adjacent part of a can when the cup is placed onto the can upside down, whereby the stop determines the extent to which the cup confines the can. Such stop can be provided on the bottom wall (e.g., at the concave inner side of the bottom wall) of the cup or on the closure.

The seal can constitute a peripheral portion of the bottom wall of the cup, and such peripheral portion is movable into sealing engagement with that surface of the marginal portion of a can which surrounds the top wall portion. To this end, the just mentioned surface of the marginal portion is preferably a conical surface which tapers inwardly toward the top wall portion, and the peripheral portion of the bottom wall of the cup has a complementary conical shape to enable the peripheral portion of the bottom wall to move into a pronounced surface-to-surface contact with the marginal portion of the can when the cup is placed over the can upside down so that it confines a certain part of the can.

The annular seal can constitute an inwardly extending annular protuberance which surrounds the bottom wall of the cup and connects the bottom wall to the respective end portion of the tubular wall. The protuberance can abut against the marginal portion and/or against the top wall portion of the can when the cup is placed onto the can in such position that the marginal portion and the top wall portion of the can are confined in the interior of the cup. If the can has an outwardly extending annular bead which forms part of or surrounds the marginal portion, the tubular wall of the cup can be provided with an internal shoulder which engages the bead with snap action to thereby hold the annular seal in engagement with the marginal portion and/or with the top wall portion of the can. The internal shoulder can constitute a circumferentially complete shoulder or it can include a plurality of discrete shoulders provided on inwardly extending portions (e.g., ribs) of the tubular wall.

The aforementioned relief valve can be provided in the annular seal of the closure which is used in conjunction with a can. Such valve can comprise a resilient valving element which tends to assume a sealing position. The seal which includes the relief valve is preferably arranged to engage the top wall portion of the can. The seal can include an annular portion which connects the bottom wall with the tubular wall of the cup, and the valve can constitute an elastically deformable part of the annular portion of the seal. For example, the valve can constitute a circumferentially complete annulus and the cup can comprise a weakened portion which connects such valve to the annular portion of the seal. Detent means can be provided to hold the cup in engagement with the can so that the closure seals the opening of the can with a force which suffices to ensure that the cup does not become detached from the can when the pressure in the can rises to a value at which the valve opens.

The novel features which are considered as characteristic of the invention are set forth in particular in the appended claims. The improved vessel itself, however, both as to its construction and the mode of using the same, together with additional features and advantages thereof, will be best understood upon perusal of the following detailed description of certain specific embodiments with reference to the accompanying drawing.

BRIEF DESCRIPTION OF THE DRAWING

FIG. 1 is a somewhat schematic partly side elevational and partly central vertical sectional view of a vessel which embodies one form of the invention and wherein the closure constitutes a cap and is integral with and extends outwardly from the recessed bottom wall of the cup;

FIG. 2 illustrates the vessel of FIG. 1 in inverted position, with the cap-shaped closure applied over the open end portion of a bottle;

FIG. 3 is a view similar to that of FIG. 2 but showing a cup whose bottom wall has a weakened portion to facilitate complete separation of the cap-shaped closure from the cup;

FIG. 4 is a view similar to that of FIG. 2 but showing a cup with two bottom walls one of which embodies the feature of FIG. 3, and wherein the tubular wall of the cup is provided with an annular intercepting device for remnants of liquid;

FIG. 5 is a view similar to that of FIG. 2 but showing a cup with a non-recessed bottom wall and with a cork-shaped closure which is integral with and is disposed at the inner side of the bottom wall;

FIG. 6 is a view similar to that of FIG. 5 but showing a modified cork-shaped closure which is held in sealing position by a socket forming part of the bottom wall of the cup and engaging the annular bead surrounding the open end portion of a bottle;

FIG. 7 shows the inner side of the bottom wall of the cut which is shown in FIG. 6;

FIG. 11 is a fragmentary side elevational view of a modified vessel wherein the closure forms an integral part of the tubular wall and is adjacent to the rim;

FIG. 12 is a smaller-scale fragmentary schematic elevational view of a vessel wherein the cup carries three different closures;

FIG. 15 is a fragmentary sectional view of the top wall portion and marginal portion of a can and of a modified vessel whose closure can establish a seal with the can to prevent spillage of a liquid from the interior of the can;

FIG. 16 is a similar fragmentary sectional view of a can of the type shown in FIG. 15 and of a modified vessel;

FIG. 17 is a similar fragmentary sectional view of a can and of a modified vessel whose closure is provided with two annular seals analogous to those shown in FIG. 15;

FIG. 18 illustrates a modification of the structure which is shown in FIG. 17;

FIG. 20 is a fragmentary view of the inner side of the bottom wall of the cup forming part of a further vessel wherein the bottom wall is provided with a relief valve;

FIG. 21 is a fragmentary sectional view as seen in the direction of arrows from the line XXI-XXI of FIG. 20;

FIG. 22 is a fragmentary perspective view of a can and of the bottom wall of a cup forming part of a vessel wherein the closure is insertable into the opening in the top wall portion of the can;

FIG. 23 is a fragmentary perspective view of a further vessel wherein the closure constitutes an integral annular resilient portion of the bottom wall and engages the top wall portion of the can;

DESCRIPTION OF THE PREFERRED EMBODIMENTS

Figure 8:
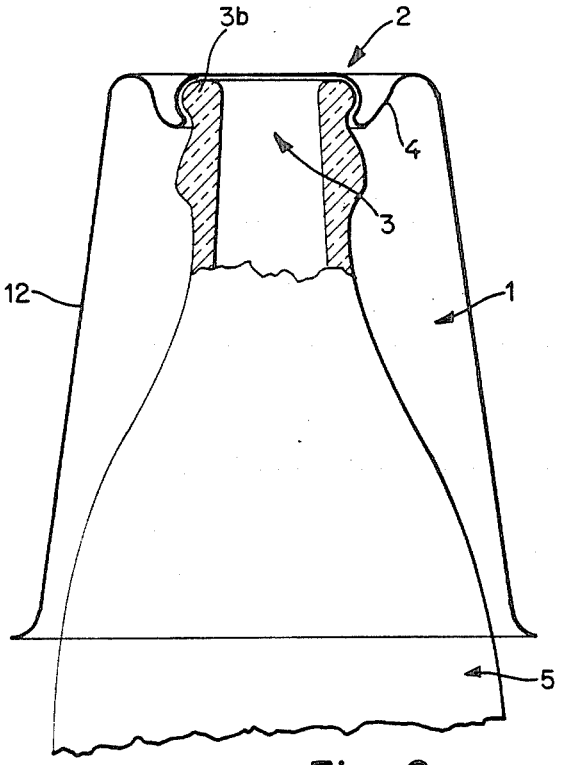
FIG. 8 is a view similar to that of FIG. 2 but showing a different cap-shaped closure for the open end portion of a bottle.

FIG. 1 shows a vessel which comprises a substantially frustoconical non-collapsible drinking cup 1 and a cap-like closure 2 which is integral (i.e., of one piece) with the central portion of the bottom wall 4 of the cup. The latter further comprises a tubular wall 12 which flares outwardly from the bottom wall 4 and terminates in a rim 14. The closure 2 extends outwardly from the bottom wall 4 and its deepmost portion is flush or substantially flush with the lower edge face of the annular base or leg 12*a* which is defined by the tubular wall 12 because the bottom wall 4 is slightly recessed. The closure 2 and the cup 1 consist of a suitable synthetic plastic material which can be sufficiently thin to allow for crushing after a single use or after a small number of uses, or which is sufficiently rigid to warrant repeated washing and reuse with a succession of bottles. The material of the cup 2 is at least slightly elastic.

FIG. 2 shows the vessel of FIG. 1 in actual use on an open bottle 5. The open top portion or end portion 3 of the neck 3*a* of the bottle 5 has a circumferential bead 3*b* which engages, with snap action (due to elasticity of the material of the closure), the annular portion 2' of the cap-shaped closure 2 so that the end wall 2" of the closure 2 overlies the open top portion 3 and bears against the upper end face 3*c* of the bead 3*b*. The bead 3*b* has a partly spherical external surface and the closure 2 has a complementary concave internal surface. The material of the closure 2 is sufficiently elastic to allow for manual application of this closure to the neck 3*a* as well as for manual separation of the closure from the bottle 5. The dimensions of the tubular wall 12 can be selected in such a way that the internal surface 12*b* of this tubular wall contacts the external surface of the major portion of the bottle 5 when the closure 2 is in proper fluidtight engagement with the bead 3*b*. This ensures adequate centering of the inverted cup 1 on the bottle 5 and reduces the likelihood of accidental separation of the closure 2 from the bead 3*b*. It will be noted that the space requirements of the vessel and bottle 5 do not appreciably exceed the space requirements of the bottle alone. The properly applied closure 2 can adequately seal the interior of the bottle 5 from the surrounding atmosphere to preserve the freshness of a carbonated beverage which fills a portion of the bottle when the bead 3*b* is engaged by the closure 2.

The vessel can be mass-produced in an injection molding machine from a synthetic plastic material which exhibits sufficient elasticity to allow for temporary expansion of the annular portion 2' of the closure 2 when the concave internal surface of the latter is applied over the partly spherical (convex) external surface of the bead 3*b* of a bottle 5 to ensure fluidtight sealing of the open top portion 3 (as shown in FIG. 2) as well as to allow for manual detachment of the closure 2 from the bead 3*b* when the purchaser or recipient of the bottle 5 desires to gain access to the remainder of its contents. The closure 2 is free to swivel, within limits, relative to the bead 3 without interrupting the seal between the closure and the bottle. The exact nature of the original closure for the bottle 5 is of no consequence; such original closure can be a crown cork, a plastic cap with a tear strip or a cap which has a screw thread adapted to mesh with a screw thread at the exterior of the open top portion 3.

The purchaser or recipient of a bottle 5 and of a vessel which embodies the present invention may wish to reseal the bottle but to dispense with the cup 1, e.g., when the bottle is to remain sealed for extended intervals of time. As shown in FIG. 3, the bottom wall 4 of the cup 1 can be provided with an annular weakened portion 10 defining a break-away zone 11 which allows for convenient manual separation of the closure 2 from the cup 1. The cup 1 is then discarded and the annular collar 2A which forms an integral part of the separated closure 2 facilitates convenient detachment of the closure from the bead 3*b* when the user so desires. In other words, the collar 2A can be said to constitute a rudimentary handle which simplifies the task of the user who attempts to gain access to the contents of the bottle 5. The weakened portion 10 is a breakable joint which may be formed by reducing the thickness of the material of the bottom wall 4 so that the bottom wall breaks around the collar 2A in response to the exertion of a certain force. Alternatively, the weakened portion 10 can be constituted by a flexible membrane which is destroyed in response to the application of the aforementioned force. Such force is greater than the force which must be applied in order to snap the closure 2 of FIG. 3 onto or to detach such closure from the bead 3*b*. The weakened portion 10 of FIG. 3 is fluidtight so that it does not interfere with proper use of the cup 1 prior to separation of the closure 2 from the bottom wall 4. For example, the weakened portion 10 in the bottom wall 4 of FIG. 3 can be caused to break by pushing the major part of the cup 1 downwardly beyond the position of FIG. 3 so that the collar 2A becomes separated from the remainder of the bottom wall 4. In the next step, the separated cup 1 is lifted off the bottle 5 and is discarded.

FIG. 4 shows a modified vessel wherein the bottom wall 4 of the cup 1 is again formed with a circumferentially complete annular weakened portion 10 to allow for separation of the collar 2A of the closure 2 from the remainder of the bottom wall. However, the bottom wall 4 constitutes an inner or second bottom wall (hereinafter called transverse wall) which is spaced apart from the main or outer bottom wall 4*a* of the bottom of the cup 1. Thus, when the transverse wall 4 is caused to break in the zone 11, the cup 1 of FIG. 4 is still capable of performing its basic function of storing a selected quantity of liquid because the outer or main bottom wall 4*a* remains intact. The transverse wall 4 is parallel to the outer bottom wall 4*a* and is closer to this bottom wall than to the rim 14 of the cup 1.

FIG. 4 further shows that the cup 1 can be provided with an annular intercepting device 13 in the form of a trough which is preferably adjacent to the rim 14 and is provided on the internal surface 12*b* of the tubular wall 12. The device 13 has an annular wall 15 which slopes inwardly and away from the internal surface 12*b* toward the transverse wall 4 so as to define with the internal surface 12*b* an annular compartment having a substantially triangular cross-sectional outline. The compartment intercepts the remnants of liquid which rest on the transverse wall 4 and/or in the recess of the closure 2 before the cup 1 is turned upside down preparatory to attachment of the closure 2 to the bead 3*b* of the bottle 5. In addition, the wall 15 of the intercepting device 13 can serve as a means for centering the cup 1 on the bottle 5 while the closure 2 is held in sealing engagement with the bead 3*b*. Such centering further reduces the likelihood of accidental separation of the closure 2 from the bead 3*b* and/or the escape of liquid from the compartment which is defined by the intercepting device 13. The intercepting device 13 further reduces the likelihood of contamination of the external surface of the neck 3*a* of the bottle 5 by the liquid which remains in the cup 1 while the latter is inverted and placed onto the bottle in a manner as shown in FIG. 4.

FIG. 4 further shows (by broken lines) that the annular outer portion 15' of the transverse wall 4 can be made to slope in the same direction as the wall 15 of the intercepting device 13. Thus, the portion 15' constitutes a second intercepting device which is closely adjacent to the outer bottom wall 4*a* and becomes effective upon destruction of the weakened portion 10, i.e., upon complete separation of the closure 2 and its collar 2A from the remainder of the transverse wall 4. The collar 2A can be separated from the portion 15' by pushing the cup 1 in the direction which is indicated by the arrow Pf1 whereby the wall 15 is flexed toward the adjacent portion of the internal surface 12*b* of the tubular wall 12 to allow for movement of the bottom wall 4*a* toward the end wall 2" of the closure 2.

FIG. 8 shows a vessel which is similar to that of FIG. 1 except that the flat bottom wall 4 of FIG. 1 is replaced with an inwardly bent annular bottom wall 4 which merges into the radially outermost portion of the closure 2. The latter engages the bead 3*b* of the bottle 5 in the same way as shown in FIG. 2. The slightly conical tubular wall 12 of the cup 1 can be replaced with a cylindrical wall without departing from the spirit of the invention.

FIG. 5 shows a modified vessel wherein the closure 2*a* is again integral with the cup 1 but constitutes a cork or stopper which is insertable into and then sealingly engages the internal surface 3*d* of the open top portion 3 of the bottle 5. The closure 2*a* can resemble, constitute or include a cone which is deformable for insertion into the open top portion 3 and which is integral with and extends inwardly from the bottom wall 4 of the cup 1. In the embodiment of FIG. 5, the closure 2*a* has a conical portion 6 which tapers inwardly in a direction away from the bottom wall 4 and carries a disc-shaped platform 6*a* whose marginal portion is in sealing engagement with the internal surface 3*d* when the closure 2*a* is properly inserted into the open top portion 3 of the bottle 5. The exact nature of the closure 2*a* will depend on the preference of the manufacturer and on the availability of machinery which is used for the making of a vessel embodying the cup 1 and the closure 2*a* of FIG. 5. Furthermore, the exact nature of the closure 2*a* will depend on the desired sealing and/or retaining action between the cork-shaped closure and the internal surface 3*d*. An advantage of the vessel which is shown in FIG. 5 is that the configuration of the closure 2*a* is not dependent upon the outline of the external surface of the neck 3*a* (i.e., whether such external surface is formed in part by a bead, by a screw thread or the like) but depends exclusively on the diameter of the surface 3*d*. Thus, the versatility of the vessel of FIG. 5 is quite pronounced and, moreover, its sealing action is highly satisfactory.

Figure 9:
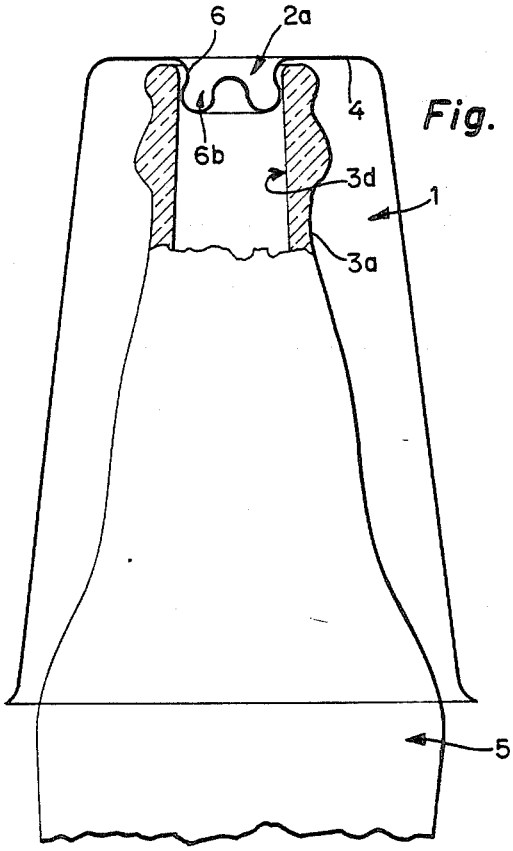
FIG. 9 is a view similar to that of FIG. 8 but showing a modified cork-shaped closure.

FIG. 9 shows a vessel which is very similar to that of FIG. 5 except that the closure 2*a* (which again constitutes or performs the function of a cork) is somewhat different from the closure of FIG. 5. Thus, the closure 2*a* of FIG. 9 does not exhibit a pronounced platform (such as the platform 6*a* of FIG. 5); instead, the conical portion 6 is integral with a hollow annular bead 6*b* which engages the internal surface 3*d* of the neck 3*a*.

FIG. 6 shows a vessel wherein the cup 1 is integral with a modified closure 2*b* which includes a stopper or cork 6 as well as a substantially annular socket 7 which can engage and hold the convex external surface of the bead 3*b* on the bottle 5. When the closure 2*b* is applied to the open top portion 3, the substantially conical cork 6 extends into the open top portion and can sealingly engage the internal surface 3*d* and/or the end face 3*c* as soon as the socket 7 snaps over the bead 3*b*. The structure of FIG. 6 is desirable and advantageous when the user wishes to establish a reliable and pronounced sealing action between the closure and the bottle 5. The clamping action of the socket 7 upon the bead 3*b* can be varied within a wide range, depending on the nature of the material of the closure 2*b*, on the thickness of the socket, on the number of prongs which form the socket and/or on the configuration of the bead 3*b*. In fact, if the socket 7 constitutes a circumferentially complete ring, it can also perform a sealing action by moving its internal surface into fluidtight engagement with the external surface of the bead 3*b*.

If the manufacturer does not wish to design the socket 7 with a view to invariably establish a fluidtight seal between the socket and the bead 3*b* (e.g., because this could result in entrapment of some liquid between the cork 6 and the socket 7 when the cup 1 is held in the position of FIG. 6), the socket 7 can be designed in a manner as shown in FIG. 7. The socket of FIG. 7 includes an annulus of arcuate prongs or webs 8 which are separated from each other by relatively narrow gaps or slots 9. The number of prongs 8 can be greatly increased to thus enhance their elasticity and the ease with which the socket of FIG. 7 is snapped over the bead of a bottle. The radially extending slots 9 can be replaced with closed slots or holes if the manufacturer wishes to enhance the elasticity of a circumferentially complete socket. The cork 6 of FIG. 7 is or can be identical with the cork 6 of FIG. 5, 6 or 9.

Figure 10:
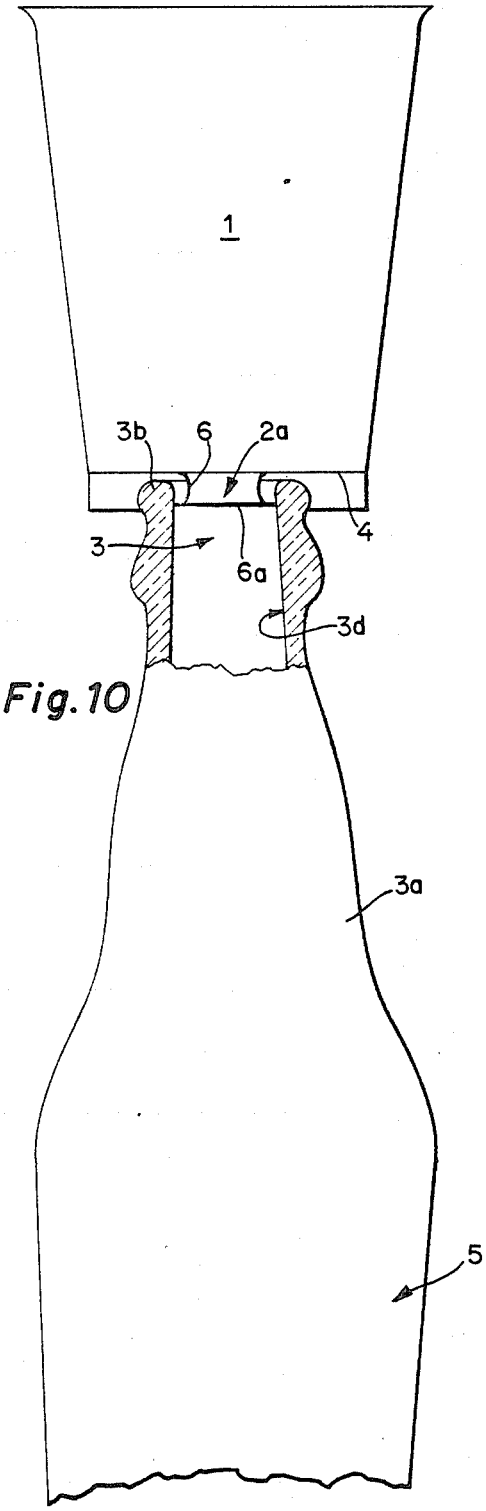
FIG. 10 is a fragmentary partly elevational and partly sectional view of a bottle and a schematic sectional view of a vessel whose cup has a cork-shaped closure at the outer side of its bottom wall.

FIG. 10 illustrates a closure 2*a* which is very similar to the closure 2*a* of FIG. 5 except that it is provided at the outer side of the bottom wall 4. Thus, when the platform 6*a* on the conical portion 6 of this closure engages the internal surface 3*d*, and thereby sealingly engages the neck 3*a*, of the bottle, the cup 1 extends upwardly and above the bead 3*b*. The vessel of FIG. 10 exhibits the advantage that remnants of liquid which might be present in the cup 1 when the closure 2*a* is attached to the bead 3*b* cannot flow downwardly and contaminate the external surface of the bottle 5. On the other hand, the space requirements of the combination of a bottle and a vessel whose closure is provided at the inner side of the bottom wall or on a transverse wall are but a fraction of space requirements of the combination which is shown in FIG. 10.

Referring to FIG. 11, there is shown a portion of a cup 1 which is integral with a closure 2*c*. The latter is provided on and forms an integral part of the tubular wall 12 and is adjacent to the rim 14. The closure 2*c* comprises a cork 6 which can resemble the cork of FIG. 5 or 9 and extends into the interior of the cup 1. A substantial portion of the cork 6 is surrounded by an arcuate weakened portion 16 constituting a modified break-away zone 11'. The weakened portion 16 can constitute a breakable membrane which is destroyed to provide a slot when the user wishes to insert the cork 6 into the open top portion of a bottle. The cork 6 is then flexed outwardly (i.e., toward the observer of FIG. 11) so that the cup 1 is laterally adjacent to the neck of the bottle whose open top portion receives the cork. The space requirements of the combination including the vessel of FIG. 11 and a bottle exceed the space requirements of the combination which is shown, for example, in FIG. 2, i.e., wherein the closure is provided on the bottom wall of the cup and the closure can be applied to the open top portion of a bottle after the cup is placed over the neck in inverted position. On the other hand, the vessel 1 of FIG. 11 can be mass-produced at a very low cost. The membrane 16 can be replaced with a weakened portion 10 of the type shown in FIGS. 3 and 4.

It is possible to modify the vessel of FIG. 11 in such a way that, when the membrane 16 is intact, the cork 6 extends outwardly, i.e., beyond the outer side of the tubular wall 12. When the membrane 16 is destroyed to provide a slot partially surrounding the closure, the closure must be pivoted through 180° in order to be in an optimum position for insertion of the cork 6 into the open top portion of a bottle. The membrane 16 can be readily destroyed in response to the application of a requisite force against the closure 2*c* from the inner side of the cup 1. The portions 14*a* of the rim 14 constitute hinges or webs which allow for pivoting of the partially separated closure 2*c* relative to the tubular wall 12. If desired, the membrane 16 can extend all the way to the rim 14, i.e., the closure 2*c* can be designed for complete separation from the cup 1.

FIG. 12 shows further embodiments of the improved vessel wherein, for the sake of reducing the number of Figures, the cup 1 carries three different closures 2*d*, 2*e* and 2*f*. In actual practice, the cup 1 will be made integral with the closure 2*d*, 2*e* or 2*f*.

The closure 2*d* is or includes a cork having a conical portion which can be fitted into the open top portion 3 of a bottle to sealingly engage the internal surface 3*d* of such bottle. This closure 2*d* can further comprise an equivalent of the socket 7 shown in FIG. 6 in order to ensure more reliable retention of the cork in the open top portion of the bottle and/or to establish an additional fluidtight seal with the bead surrounding the open end of the bottle. The connecting means between the closure 2*d* and the rim 14 of the cup 1 comprises a flexible filamentous element 17 which can be broken or severed to allow for the use of the closure 2*d* independently of the cup 1 and/or vice versa. The connecting means 17 preferably consists of a suitable synthetic plastic material which is normally the same as that of the closure 2*d* and/or cup 1. It is clear that the connecting means 17 can be made integral with the other end portion of the tubular wall 12 of the cup 1 or with an intermediate portion of such tubular wall.

The closure 2*e* also comprises or constitutes a cork which is mounted on an outwardly extending arm 17*a* of the cup 1 in cantilever fashion. The arm 17*a* (which is a functional equivalent of the filamentous connecting means 17) can be provided with a weakened portion to facilitate complete separation of the closure 2*e* from the cup 1.

The closure 2*f* resembles the closure 2*e* except that it lies against the outer side of the tubular wall 12 when not in use. A hinge or other suitable connecting means is preferably provided (e.g., at 17*b*) to pivotally connect the closure 2*f* to the rim 14 so that the closure can be pivoted through 90° to a position in which its conical cork can be inserted into the open top portion of a bottle. Such hinge preferably allows for complete separation of the closure 2*f* from the cup 1.

Each of the closures 2*c*, 2*d*, 2*e* and 2*f* can further serve as a handle or handgrip which allows for more convenient manipulation of the cup 1. This is advisable and advantageous when the cup 1 is designed to receive a hot beverage so that the tubular wall 12 is rapidly heated and cannot be readily touched by the user's hand.

It is further within the purview of the invention to construct the closure (e.g., the closure 2 of FIG. 1) in such a way that it can be readily applied to the open end portion of a bottle but cannot be manually detached therefrom. For example, the closure 2 of FIG. 3 can constitute or include a conventional crown cork which can be manually applied to the bead 3*b* of the bottle 5. However, in order to remove such closure, the user must break the weakened portion 10 to separate the cup 1 from the closure and to thereupon employ a bottle opener, a coin or another rudimentary tool in order to detach the separated closure 2 from the bottle.

Figure 13:
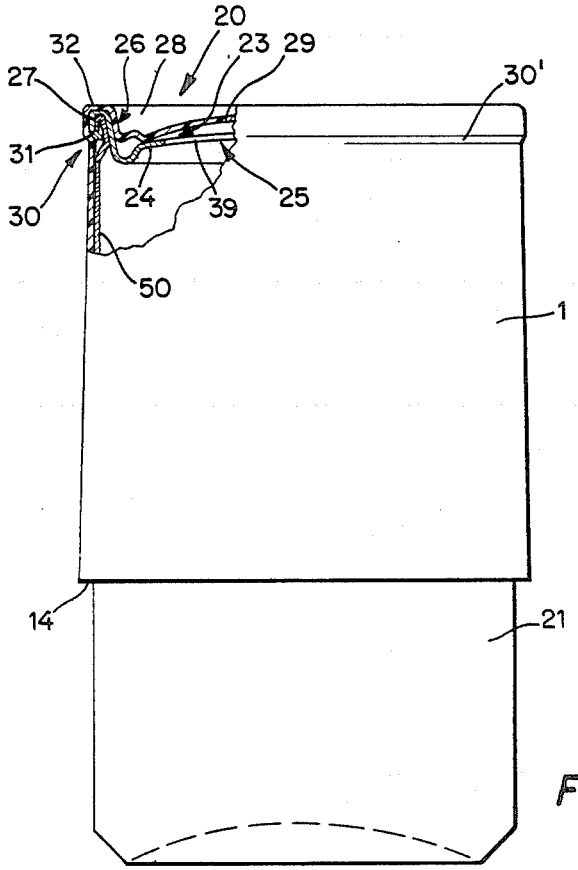
FIG. 13 is a partly elevational and partly sectional view of a vessel whose closure is designed to seal the opening in the top wall portion of a metallic or plastic can.
Figure 14:
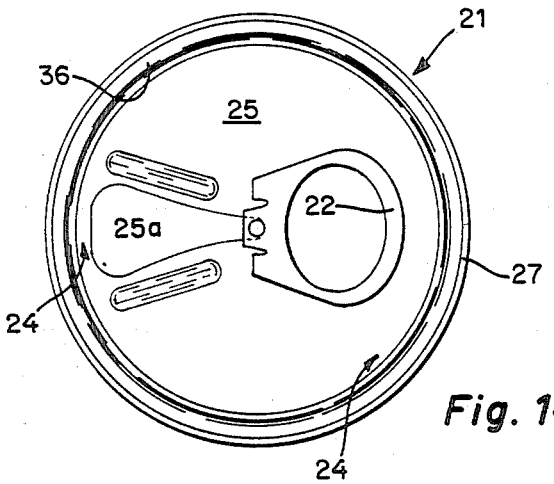
FIG. 14 is a plan view of a can which can be used in combination with the vessel of FIG. 13.

FIG. 13 shows a modified vessel which has a substantially cylindrical cup 1 and a closure 20 which can be applied to the upper portion of a metallic or plastic can 21. As shown in FIG. 14, the top wall portion 25 of the can 21 has a customary lift-off lug 22 which is connected with an integral section 25*a* of the top wall portion 25 and can remove the section 25*a* so as to form an opening 39 (FIG. 22) bounded by a marginal zone 38 of the top wall portion 25. An important advantage of the vessel of FIG. 13 is that it comprises a closure 20 which can seal the opening 39 from the surrounding atmosphere, a task which cannot be achieved by resorting to customary corks or analogous stoppers.

The cup 1 is placed onto the top portion of the can 21 in inverted position so that the rim. 14 is located at the lower end of the tubular wall 12. The closure 20 comprises an annular seal 23 which engages the top wall portion 25 of the can 21 at 24, namely, in a region which spacedly surrounds the opening 39. The closure 20 further comprises a second annular seal 26 which engages a conical surface 36 of the annular marginal portion 27 of the can 21, namely, that portion of the can which connects the top wall portion 25 with the cylindrical wall 50. The second seal 26 is defined by the frustoconical peripheral portion 28 of the concavo-convex bottom wall 29 of the cup 1, and the internal surface of the peripheral portion 28 has a conical shape complementary to that of the surface on the annular marginal portion 27 of the can 21. An advantage of two annular seals (23, 26) is that they reliably prevent escape of liquid from the opened can 21 as long as the cup 1 is held in the position of FIG. 13. It will be noted that the seal 23 engages the top wall portion 25 whereas the seal 26 engages the marginal portion 27 of the can 21. As a rule, the primary sealing function will be performed by the inner seal 23; the outer seal 26 primarily constitutes a safety feature and becomes effective if the seal 23 fails, e.g., due to excessive deformation of the top wall portion 25 of the can 21 and/or bottom wall 29 of the cup 1. FIG. 13 further shows that the bottom wall 29 is slightly recessed, i.e., that the marginal portion 32 of the cup 1 which constitutes a junction or joint between the peripheral portion 28 of the bottom wall 29 and the adjacent end portion of the tubular wall 12 can constitute a leg which comes in contact with the surface of a table or a similar support for the cup 1.

The can 21 and the cup 1 further comprise cooperating detent means for respectively urging the seals 23 and 26 against the portions 25 and 27 of the can. The detent means comprises a circumferential bead 31 which forms part of the marginal portion 27 of the can 21 and an annular internal shoulder 30 of the tubular wall 12 in the region of the joint 32. When the cup 1 is turned upside down and is pushed toward the position of FIG. 13, the internal shoulder 30 slides over and thereupon snaps behind the lower edge face of the bead 31 to thereby urge the seal 26 against the marginal portion 27 and to simultaneously urge the seal 23 against the upper side of the top wall portion 25 of the can 21. The shoulder 30 is formed by providing the tubular wall 12 with a circumferentially complete annular corrugation 30' which can be readily seen in the right-hand portion of FIG. 13. The retaining action of the detent means 30, 31 is sufficiently pronounced to ensure that the liquid cannot spill via opening 39 of the can 21 even if the latter is overturned or otherwise caused to change its orientation so that the opening 39 permits the liquid to flow from the interior of the can 21 against the concave inner side of the bottom wall 29 of the cup 1.

FIG. 17 shows the combination of a can 21 and a vessel which is very similar to the combination of FIG. 13 except that the closure 20 comprises a single annular seal 23. Thus, the peripheral portion 28 of the bottom wall 29 of the cup 1 is spaced apart from the conical surface 36 of the marginal portion 27 of the can 21 when the internal shoulder 30 of the tubular wall 12 engages the lower edge face of the bead 31. FIG. 17 further shows that the junction 32 need not be in physical contact with the marginal portion 27 when the shoulder 30 engages the lower edge face of the bead 31 and the annular seal 23 bears against the top wall portion 25; this enhances the sealing action at 24 because the parts 27 and 32 cannot prevent the seal 23 from bearing against the outer side of the top wall portion 25 with a force which is determined solely by the location of the shoulder 30 and elasticity of the materials of the can 21 and cup 1. A certain force which urges the seal 23 against the top wall portion 25 is desirable and advantageous, especially if the bottom wall 29 or another portion of the cup 1 is provided with one or more relief or safety valves one of which is shown in FIGS. 20 and 21. The magnitude of the just mentioned force can be selected by the manufacturer of cups 1 by the simple expedient of placing the internal shoulder 30 at a selected distance from the junction 32.

It is further desirable and advantageous to provide the can 21 and/or the cup 1 with one or more stops which determine the extent to which the cup can be pushed onto the can, i.e., the extent to which the can be is confined in the interior of the cup. Such stop can be established by the junction 32, i.e., the latter can come into actual abutment with the marginal portion 27 of the can 21 whereby the user knows that he or she can relax the pressure upon the cup because the shoulder 30 is in proper engagement with the lower edge face of the bead 31. The elastically deformable cup 1 thereupon moYes its junction 32 away from the marginal portion 27 with the aforediscussed desirable result, namely, that the junction 32 cannot influence the force with which the seal 23 engages the outer side of the top wall portion 25.

The seal 23 also constitutes a stop which can serve as a means for limiting the extent to which the cup 1 may be applied over the can 21. The same holds true for the annular stop 26 of FIG. 13. The proYision of one or more stops is desirable and advantageous because they prevent bursting of or other damage to the cup 1 which is likely if the latter is applied with excessive force. The likelihood of bursting of the cup 1 in response to the application of excessive pressure in a direction to move the can 21 deeper into the interior of the cup is more pronounced if the tubular wall 12 of the cup has a conical end portion 33 (see FIG. 15) which is integrally connected to the peripheral portion 28 of the bottom wall 29 by the junction or joint 32.

The structure of FIG. 15 is similar to that of FIG. 17 except that the conical portion 33 of the tubular wall 12 constitutes an element of the closure 20 in that it sealingly engages the external surface of the bead 31. The corresponding annular seal is shown at 34. Such seal replaces the seal 26 of FIG. 13 and constitutes a safety feature which becomes effective in the event of failure of the annular seal 23 which engages (at 24) the outer side of the top wall portion 25 of the can 21. When the cup 1 is pushed onto the can 21, it can be moved downwardly beyond the position which is shown in FIG. 15 so that the junction or joint 32 comes into actual contact with the marginal portion 27. This prevents further downward movement of the cup 1 and the elasticity of the material of the cup thereupon causes the junction 32 to move upwardly and away from the marginal portion 27.

It will further be noted that the tubular wall 12 of the cup 1 which is shown in FIG. 15 need not have an internal shoulder (such as the shoulder 30 in FIG. 17) because the internal surface of the conical portion 33 is maintained in pronounced frictional engagement with the external surface of the bead 31 so that the seal 23 continues to bear against the top wall portion 25 with a force which suffices to normally prevent spillage of liquid from the interior of the can 21 radially outwardly beyond the locus 24.

FIG. 16 illustrates a modified vessel wherein the closure 20 comprises a single annular seal 26 between the peripheral portion 28 of the bottom wall 29 of the cup 1 and the conical surface 36 of the marginal portion 27 of the can 21. The conicity of the inner surface of the peripheral portion 28 preferably matches that of the surface 36. The parts 28 and 27 are held in requisite sealing engagement because the seal 26 is in relatively large frictional surface-to-surface contact with the marginal portion 27.

FIG. 18 shows a further modification with a closure 20 having three annular seals 23, 26 and 34. To this end, the bottom wall 29 of the cup 1 is provided with a hollow annular protuberance 35 which engages the outer side of the top wall portion 25 at 24 to form the seal 23 and which also engages the conical surface 36 of the marginal portion 27 to form the seal 26. The third seal 34 is formed by the uppermcst portion of the tubular wall 12 in cooperation with the external surface of the bead 31. The lower edge face of the bead 31 is engaged by the annular internal shoulder 30 of the tubular wall 12. This shoulder is defined by the annular corrugation 30' of the tubular wall 12. The protuberance 35 of FIG. 18 can fcrm part of or is inwardly adjacent to the peripheral portion 28 of the bottom wall 29.

The structure FIG. 18 is desirable and adYantageous when the manufacturer of the cup 1 desires to further reduce the likelihood of escape of some liquid into the space between the tubular wall 12 and the external surface cf the cylindrical wall 50.

If desired, the hollow rotuberance 35 can be replaced by one or more sealing lips on the bottom wall 29 of the cup 1. It is also possible to replace the circumferentially complete annular corrugation 30' with a series of spaced-apart arcuate corrugations, i.e., to replace the circumferentially complete annular shoulder 30 with several arcuate shoulders, as long as such discrete shoulders can properly engage the lower edge face of the bead 31 so as to ensure that the protuberance 35 is maintained in proper sealing engagement with the portions 25 and 27 of the can 21.

It has been found that the closure of FIG. 13, 15, 16, 17 or 18 is sufficiently fluidtight to prevent the liquid from spilling via opening 39 in the top wall portion 25 of an open can 21, as long as the respective cup 1 is properly attached to the can. This holds true even if the combination of a can 21 and the selected cup 1 is subjected to rough treatment, e.g., in a knapsack, or when the combination of can 21 and cup 1 is dropped from a table, and/or under other circumstances where one would anticipate some spillage of liquid from the can.

It was further found that the placing of a seal as close as possible to the opening 39 constitutes a highly desirable feature of the improved closure 20 because this reduces to a minimum the quantity of liquid which can escape from the interior of the can 21 into the space between the top wall portion 25 and the bottom wall 29 when the can is overturned while the cup 1 is attached thereto.

The escape of any liquid into the space between the top wall portion 25 of the can 21 and the bottom wall 29 of the cup 1 can be prevented if the bottom wall 29 is provided with a projection 37 (see FIG. 22) which can fit snugly into the opening 39 or which can be designed to sealingly engage the marginal zone 38 of the top wall portion 25 around the opening 39. In such embodiment of the cup, at least that portion of the cup which includes the bottom wall 29 is preferably made of a light-transmitting material (such as a transparent or translucent synthetic plastic substance) to facilitate the insertion of projection 37 in proper orientation or to facilitate the placing of the projection 37 into sealing engagement with the entire marginal zone 38 around the opening 39. The dimensions of the projection 37 can be readily selected in such a way that the projection fits snugly into and seals the opening 39 when the cup of FIG. 22 is properly attached to the can 21 because the dimensions of openings 39 on many cans are standardized so that a mass-produced cup can be used in conjunction with cans containing a wide variety of different liquids.

The projection 37 can constitute the sole seal of the closure forming part of the vessel which includes the cup 1 of FIG. 22, or such projection can constitute one of two or more seals. For example, the projection 37 can be provided on the bottom wall 29 which is shown in FIG. 15 so that it then constitutes the innermost or first seal of a series of three successive seals 37, 23 and 34. The position of the shoulder 30 (not shown in FIG. 22) on the cup including the bottom wall 29 with a projection 37 can be readily selected in such a way that the projection 37 is urged into the opening 39 and/or against the marginal zone 38 with a force which suffices to prevent the escape of any liquid when the cup is properly applied to the can. Instead of a shoulder 30, the cup of FIG. 22 can be provided with a tubular wall 12 having a conical portion 33 to ensure the establishment of satisfactory and reliable frictional engagement between such conical portion and the bead 31 of the marginal portion 27 of the can.

If the material of the cup 1 which is shown in FIG. 22 is rather rigid, mere forcible introduction of the projection 37 into the opening 39 will suffice to hold the projection 37 against unanticipated or undesirable expulsion from such opening. However, the provision of some sort of detent means is advisable in order to further reduce the likelihood of accidental detachment of the cup from the can. If the material of the bottom wall 29 and its projection 37 is relatively thin (the projection 37 can constitute an inwardly deformed portion of the bottom wall 29), the user can assist proper entry of the projection 37 into the opening 39 by his or her finger or fingers. This even further enhances the likelihold of establishment of highly satisfactory sealing engagement between the projection 37 and the top wall portion 25.

Figure 19:
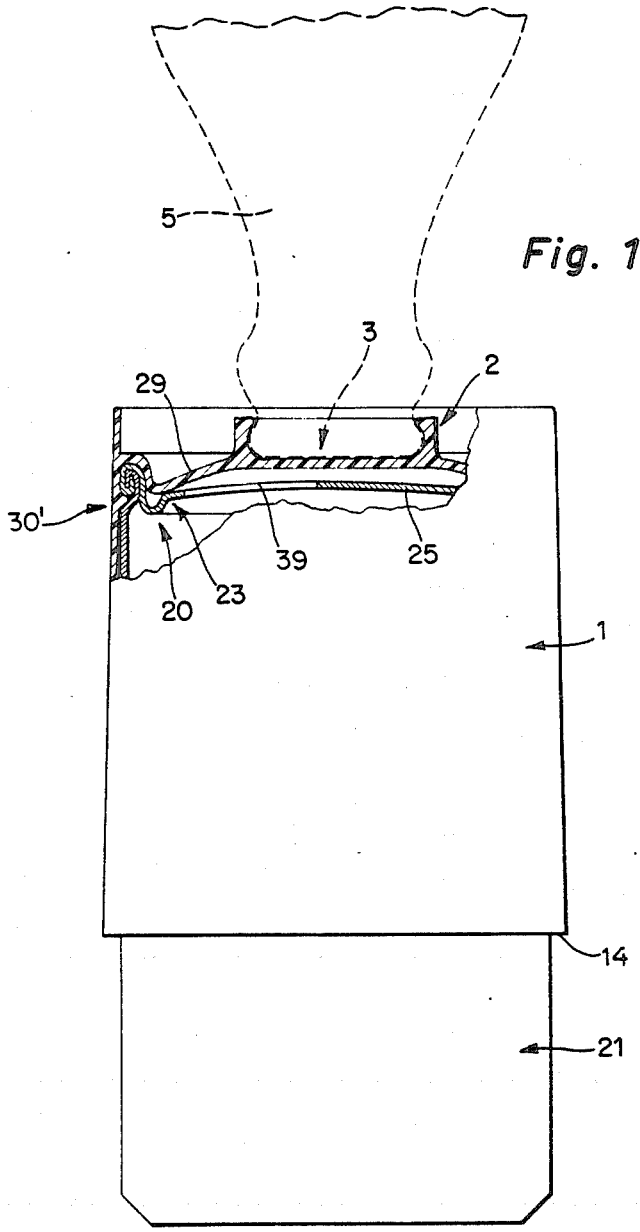
FIG. 19 is a view similar to that of FIG. 13 but showing a vessel with two closures, one for a can and another for a bottle, each of the two closures being provided on the bottom wall of the cup.

FIG. 19 shows that the cup 1 can be designed to seal a bottle 5 (a portion of a bottle is indicated by broken lines) or to seal an open can 21. The closure 20 for the can 21 may be identical with or similar to the closure of FIG. 13, and the closure 2 for the open end portion 3 of the bottle 5 may be identical with the closure of FIG. 1 or 8 except that it is provided at the outer side of the bottom wall 29. It will be seen that the bottom wall 29 of the cup 1 which is shown in FIG. 19 carries a composite closure including a first closure for a can and a second closure for a bottle.

The vessel which is shown in FIG. 19 is susceptible of numerous modifications. For example, the closure 2 can be replaced with a closure *2c, 2d, 2e* or *2f* of the type shown in FIGS. 11 and 12. Moreover, the closure 20 can surround the closure 2 at the concave inner side of the bottom wall 29 (the concavity of the inner side of the bottom wall 29 is then sufficiently pronounced to allow for proper engagement of the closure 20 with a can 21 while the closure 2 is confined between the bottom wall 29 and the top wall portion 25 of the can 21). It is also possible to install the closure 20 at the outer side of the bottom wall 29 and to place the closure 2 at the inner side of such wall, or to place the closures 2 and 20 at the outer side of the bottom wall 29. In accordance with a presently preferred embodiment (and as actually shown in FIG. 19), at least one of the closures 2, 20 is disposed inwardly of the bottom wall 29 to thus ensure that the space requirements of the combination of a can or bottle with the improved vessel are not much greater than the space requirements of the can or bottle alone. Another advantage of such mounting of the closure 2 and/or 20 that it is located at the inner side of the bottom wall 29 is that the cup 1 is much less likely to be accidentally detached from a bottle or can. Such danger is much more pronounced if the cup is mounted on a can or bottle in a manner as shown in FIG. 10. This will be readily appreciated since the rim 14 of the cup 1 shown in FIG. 19 can be caused to snugly receive the adjacent portion of the can 21 so that accidental separation of the parts 1 and 21 is much less likely. The same applies if the closure 2 is installed at the inner side of the bottom wall 29 so that the cup 1 can be placed over a bottle 5 in a manner as shown, for example, in FIG. 2, with the closure 2 fluidtightly engaging the open end portion 3 of the bottle.

Since a bottle or a can often contains a carbonated beverage, pressure in the interior of such a container can increase considerably in response to heating and/or shaking after the container is resealed by resorting to the closure of the improved vessel. Such heating and/or shaking can take place during transport of a resealed container, e.g., in a vehicle on a bumpy road, while the person holding the combination of a bottle or can with the improved vessel walks, or while the can or bottle is confined in a knapsack borne by a hiker or by a cyclist. In such instances, it is advisable to provide the improved vessel with a pressure relief valve which opens in automatic response to a pressure rise in the container beyond a predetermined maximum permissible value. Such a valve is shown at 40 in FIGS. 20 and 21. The illustrated valve 40 comprises a resilient valving element in the form of an elongated tongue-like flap 41 which forms an integral part of the bottom wall 29 of a cup 1 and tends to assume a sealing position so as to prevent the escape of liquid and/or gas from the space between the bottom wall 29 and the adjacent portion of the container which is sealingly connected with the cup including the valved bottom wall. When the cup consists of any one of a wide variety of acceptable synthetic plastic materials, the valving element or flap 41 is sufficiently elastic to normally seal the opening in the bottom wall 29 but is capable of yielding and permitting an equalization of pressures at both sides of the bottom wall 29 when the need arises. The flap 41 is shown in partly open position in FIG. 21, i.e., it is partially lifted above the slit 41*a* which surrounds the major portion of the flap so that the pressure in the interior of the container which is connected with the cup including the relief valve 40 can drop whereupon the flap 41 reassumes its sealing position within the confines of the slit 41*a*.

It is clear that the bottom wall 29 can be provided with two or more relief valves and/or that a relief valve can be provided in or on another part of the cup. The location for the relief valve or valves will depend upon the locus or loci of one or more seals which form part of the respective closure. FIG. 23 shows, by way of example, a modified relief valve 40' which is provided in the peripheral portion 28 of the bottom wall 29 adjacent to the junction 32. The closure 20 of the cup 1 which is shown in FIG. 23 comprises an annular seal 23 which engages the outer side of the top wall portion 25 of the can 21 in a manner as described above in connection with FIG. 17, and the tubular wall 12 of the cup 1 comprises a corrugation 30' defining a shoulder 30 for engagement with the lower edge face of the bead 31 (not shown) on the corresponding can 21. The relief valve 40' is provided in the region between the seal 23 and the junction 32 intermediate the peripheral portion 28 and tubular wall 12. This relief valve constitutes or includes a yieldable annular portion 43 of the peripheral portion 28 of the bottom wall 29. The yieldable portion 43 has a substantially V-shaped or U-shaped cross-sectional outline and yields when the pressure in the can 21 as well as in the space between the top wall portion 25 and the bottom wall 29 reaches a predetermined maximum acceptable value. If desired, the yieldable portion 43 can be provided with a weakened portion (such as the membrane 16 of FIG. 11 or the weakened portion 10 shown in FIG. 3) which breaks when the pressure rises so that the thus destroyed weakened portion permits for an equalization of pressures at the opposite sides of the bottom wall 29. The direction in which the pressure in the interior of the can acts upon the bottom wall 29 in order to effect a deformation of the yieldable portion 43 [i.e., an opening of the relief valve 40') is indicated by the arrow Pf2. The convex surface 42 of the annular seal 23 is then lifted off the outer side of the top wall portion 25 of the can so that the gaseous fluid can expand into the space between the peripheral portion 28 of the bottom wall 29 and the marginal portion 27 of the can. If such expansion of the gaseous fluid does not suffice (i.e., if the valve 40' including or constituting the yieldable portion 43 continues to remain open), the gaseous fluid finds its way along the junction 32, along the inner side of the tubular wall 12 and into the surrounding atmosphere. It is often preferred not to provide an additional annular seal outwardly of the annular seal 23 so that the gaseous fluid which was permitted to penetrate beyond the seal 23 in response to opening of the valve 40' including the yieldable portion 43 of the peripheral portion 28 can escape into the atmosphere. In such vessels, the corrugation 30' can consist of several slightly spaced-apart arcuate corrugations which define between themselves passages or channels for escape of the gaseous fluid when the valve 40' including the yieldable portion 43 is open.

Referring again to FIG. 17, the cup 1 which is shown therein can comprise a relief valve merely as a result of proper selection of its material and proper dimensioning of its parts. All that is necessary is to ensure that a portion of the cup 1 between the seal 23 and the corrugation 30' can yield when the pressure in the can 21 rises above a preselected maximum permissible pressure so that the yieldable portion of the cup allows the seal 23 to move away from the adjacent annular portion of the outer side of the top wall portion 25 and the pressure in the interior of the can 21 decreases because the gaseous fluid is free to escape along the inner side of the peripheral portion 28, between the junction 32 and the marginal portion 27, and along the internal surface of the tubular wall 12. If the cup 1 of FIG. 17 comprises a valve of the just outlined character, the circumferentially complete annular corrugation 30' is preferably replaced by a set of discrete corrugations which define channels or passages for the escape of gaseous fluid when the pressure in the can rises. It will be readily appreciated that the holding or retaining action of the detent means including the internal shoulder 30 and the bead 31 should suffice to ensure that the cup 1 remains attached to the can 21 even if the just discussed relief valve of the cup 1 opens and permits the gaseous fluid to escape past the seal 23 and outwardly into the space between the tubular wall 12 and the cylindrical wall 50. In other words, the relief valve should open before the rising pressure in the can 21 is capable of blowing the cup off the marginal portion 27 and top wall portion 25.

A relief valve can also be provided in or on the projection 37 of FIG. 22. This is achieved, for example, by connecting the projection 37 with the remaining portion of the bottom wall by means of a membrane (indicated at 51) which is destroyed when the pressure in the can rides to a predetermined value whereby the gaseous fluid can escape into the space between the wall 29 and the top wall portion 25; this may suffice to effect a reduction of pressure to a value at which the gaseous fluid is incapable of penetrating beyond the next seal of the closure. Furthermore, a portion of the projection 37 can constitute an elastic bellows which expands when the pressure in the can rises, and the expanded bellows provides room for expansion of the gaseous fluid without actually destroying the connection between the projection 37 and the bottom wall 29.

The relief valve or valves render it possible to store carbonated beverages in opened bottles or cans for extended periods of time without affecting the taste and flavor of such liquids. It is clear that the cups of FIGS. 1 to 12 and 19 can also comprise relief valves which open when the pressure in the respective bottles rises beyond an acceptable maximum value. For example, a valve similar to the valve 40 of FIGS. 20 and 21 can be provided in the end wall 2'' of the closure 2 shown in FIGS. 1 to 4.

Figure 24:
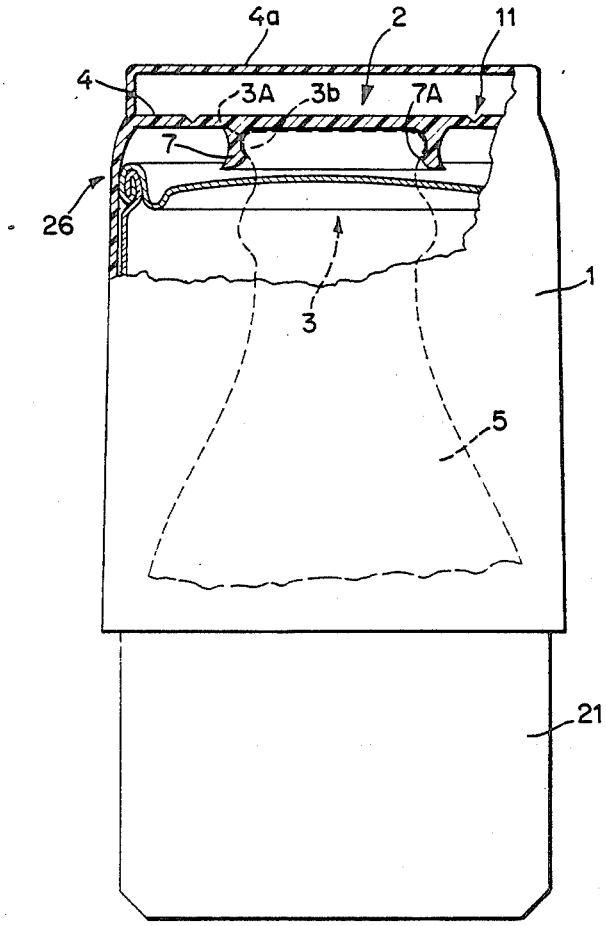
FIG. 24 is a view similar to that of FIG. 19 but showing a vessel wherein each of the closures is located at the inner side of the bottom wall.

FIG. 24 shows a modified vessel which is similar to the vessel of FIG. 19 except that the closure 2 is provided on a transverse wall 4 which, in turn, is located inwardly of the bottom wall **4*a*. The closure for the can 21 is somewhat similar to that which is shown in FIG. 16, i.e., such closure can comprise a single annular seal 26. The transverse wall 4 has a preferably circular weakened portion 11. The material of the socket 7 of the closure 2 for the end portion 3 of the bottle 5 (indicated by broken lines) is at least slightly elastic, and this socket has a concave internal surface 7A which is complementary to the partly spherical (convex) external surface 3A of the bead 3*b* so that the socket 7 can swivel (within limits) relative to the bead 3*b* without interrupting the seal between the surfaces 7A and 3A. Elasticity of the material of the socket 7 is desirable and advantageous because this can compensate for tolerances in the dimensions of the bead 3*b*. Furthermore, the liquid which is confined in the bottle 5 is less likely to spill as a result of rough handling (e.g., dropping) of the bottle while the socket 7 is applied to the bend 3*b***.

Figure 26:
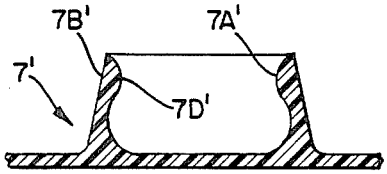
FIG. 26 is a sectional view of a closure constituting a modification of the closure which is shown in FIG. 25.
Figure 25:
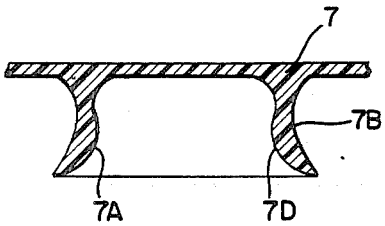
FIG. 25 is an enlarged sectional view of one of the closures in the vessel of FIG. 24.

One presently preferred form of the socket 7 for the vessel of FIG. 24 is shown in FIG. 25. The elasticity of this socket is enhanced in that the latter is formed with a concave annular external surface 7B. FIG. 26 shows a modified socket 7' which has a concave internal surface 7A' and a frustoconical external surface 7B'. The internal bead 7D or 7D' of the socket 7 of FIG. 25 of the socket 7' of FIG. 26 snaps into the circumferental groove at one axial end of the bead **3*b* to ensure reliable retention of the socket 7 or 7' on the end portion 3 of the bottle 5**.

Figure 27:
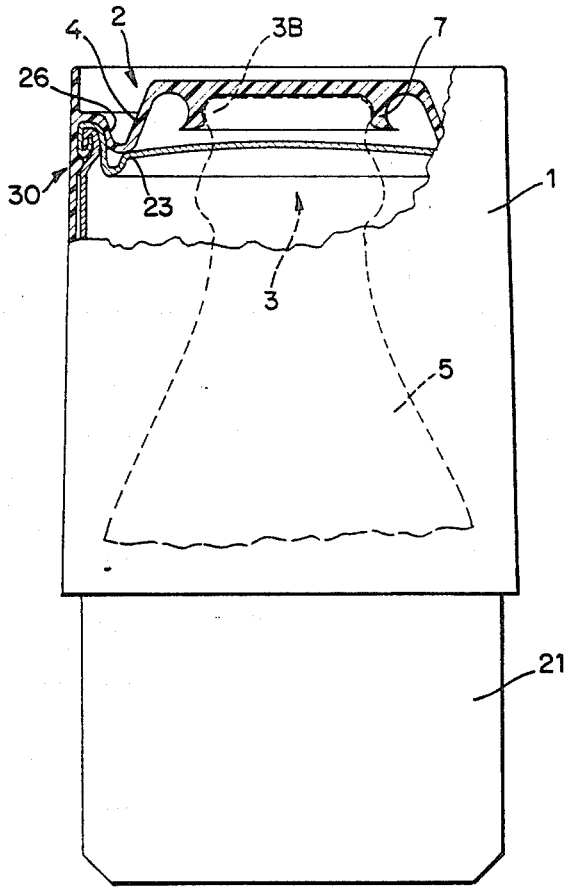
FIG. 27 is a view similar to that of FIG. 24 but showing a modified vessel without a transverse wall.

FIG. 27 shows a modified vessel wherein the closure 2 for the open end portion 3 of a bottle 5 (indicated by broken lines) has a socket 7 which is identical with or similar to the socket 7 of FIGS. 24 and 25 except that it is provided on the bottom wall 4 rather than on a transverse wall of the cup 1. The closure for the can 21 is similar to or identical with the closure of FIG. 13, i.e., it comprises several annular seals (including those shown at 23 and 26). The socket 7 can swivel (within limits) with reference to the partly spherical external surface of the bead **3*b* forming part of the end portion 3. The material of the socket 7 is at least slightly elastic so as to ensure that the socket can engage the bead 3*b* by snap action and that the sealing engagement between the concave internal surface of the socket and the partly spherical external surface of the bead 3*b*** is not interrupted in response to swiveling of the socket relative to the bead and/or vice versa.

The features of the embodiments which are shown in FIGS. 24, 26 and 27 can be combined with each other and/or with the features of the embodiments shown in FIGS. 1–23 without departing from the spirit of the invention.

An advantage of the closure which has an elastic circumferentially complete socket of the type shown, for example, in FIG. 1, 24, 25, 26 or 27 is that such closure is even more likely to fluidtightly seal the end portion of a bottle or a like container wherein the end portion (such as the bead **3*b* of the bottle 5**) has a partly spherical external surface. Thus, such closures can readily compensate for manufacturing tolerances of the containers as well as of the improved vessels. A closure having a circumferentially complete elastic socket can establish a satisfactory seal with the external surface of a bead which is far from ideal, as long as the socket must undergo an expansion during application over the bead of the bottle. Such reliable sealing action is established in spite of the ability of the socket to swivel (within limits) relative to the bottle and/or vice versa. It can be said that the socket and the bead of the bottle constitute a swivel joint or universal joint whose sealing action is not affected by minor angular displacements of its components relative to each other.

The number of possible and advantageous applications of the improved vessel is practically unlimited. For example, a guest in a hotel, motel, inn or a similar establishment may wish to carry his or her bottle or can from the bar into his or her room. A passenger in a train or aircraft can safely place the bottle or can onto the table or arm rest without the danger of spilling in response to abrupt stoppage, acceleration or deceleration of the train or in response to shaking of the aircraft during a bumpy flight. Moreover, children can carry opened and resealed bottles or cans from the kitchen to the garden or playground without spilling the contents of the container on their way to such destinations. The vessel can be used with equal advantage in hospitals and/or nursing homes and/or sanitaria to reduce the likelihood of spilling of liquids by weak patients or elderly persons.

A further important advantage of the improved vessel is that its closure or closures prevent contamination of liquids in partially emptied bottles, cans or like containers for extended periods of time, e.g., by crawling insects on picnic tables or when a partially opened can or bottle is placed onto the ground.

Without further analysis, the foregoing will so fully reveal the gist of the present invention that others can, by applying current knowledge, readily adapt it for various applications without omitting features than, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A multiple-purpose vessel for application to the open end portion of a container whose open end portion has a partially spherical external surface, comprising a drinking cup; and at least one closure for the open end portion of the container, said cup having a bottom, and said closure being provided on said cup in the region of said bottom and including a cap which is arranged to overlie and surround the open end portion of the container and has a concave, partially spherical internal surface substantially complementary to the external surface of the container, said cap consisting at least in part of an elastically deformable material and being designed for application to the open end portion of the container by snap action so that said surfaces are in sealing contact with one another to prevent spillage of the contents of the container, and said cap having a section which is disposed on the side of said internal surface remote from said bottom and diverges outwardly in a direction away from said bottom so as flare away from the container when said cap overlies and surround the open end portion thereof, said section and the complementary partially spherical surfaces of the container and said cap providing freedom for said closure to swivel within limits with reference to the open end portion of the container while sealing contact between said surfaces is maintained.

2. The vessel of claim 1, wherein said cup is non-collapsible and said closure is disposed internally of and is of one piece with said cup, said closure including means designed to permit manual attachment of the closure to and manual detachment of the latter from the open end portion of the container.

3. The vessel of claim 1, wherein said cup is disposable.

4. The vessel of claim 1, wherein said closure constitutes the sole closure on said cup.

5. The vessel of claim 1, wherein at least said cup contains or consists of synthetic plastic material.

6. The vessel of claim 1, wherein said bottom includes a bottom wall and said closure is located on said bottom wall.

7. The vessel of claim 1, further comprising a second closure, one of said closures being disposed internally and the other of said closures being disposed externally of said cup.

8. The vessel of claim 7, wherein said second closure is also located in the region of said bottom.

9. The vessel of claim 7, wherein said cup has a rim and said other closure is located in the region of said rim.

10. The vessel of claim 7, wherein said second closure comprises a cork which is sealingly receivable in the open end portion of a bottle.

11. The vessel of claim 10, wherein at least a portion of said cork has a substantially conical shape.

12. The vessel of claim 1, further comprising means for at least partly separably connecting said closure to said cup.

13. The vessel of claim 12, wherein said connecting means comprises a membrane.

14. The vessel of claim 12, wherein said connecting means comprises a weakened portion of said cup.

15. The vessel of claim 12, wherein said connecting means comprises a breakable joint between said cup and said closure.

16. The vessel of claim 12, wherein said bottom comprises a bottom wall and said closure is disposed substantially centrally of said bottom wall, said connecting means comprising a breakable joint between said bottom wall and said closure.

17. The vessel of claim 16, wherein said joint is a fluidtight joint.

18. The vessel of claim 12, wherein said cup has a rim and a transverse wall remote from said rim, said closure being separably connected to said transverse wall.

19. The vessel of claim 18, wherein said bottom has a bottom wall outwardly adjacent to said transverse wall.

20. The vessel of claim 18, wherein said closure extends from said transverse wall toward said rim.

21. The vessel of claim 1, wherein said cup comprises a tubular wall having a first end portion constituting a rim and a second end portion, said bottom including a bottom wall closing the second end portion of said tubular wall; and further comprising a second closure constituting an integral part of said tubular wall.

22. The vessel of claim 1, wherein said cup comprises a tubular wall having an internal surface, an open first end constituting the rim of the cup and a second end, said bottom comprising a bottom wall closing the second end of said tubular wall and said cup further comprising means for intercepting remnants of a liquid which accumulate on said bottom wall and tend to flow toward and beyond said rim when the cup is turned upside down, said intercepting means being adjacent to the internal surface of said tubular wall.

23. The vessel of claim 22, wherein said intercepting means comprises an annular trough.

24. The vessel of claim 23, wherein said trough is adjacent to said rim.

25. The vessel of claim 23, wherein said trough has an inner wall sloping away from said internal surface and toward said bottom wall.

26. The vessel of claim 1, further comprising a second closure located externally of said cup and constituting a handle which facilitates the manipulation of said cup.

27. The vessel of claim 1, wherein said bottom includes a bottom wall and at least that portion of said cup which includes said bottom wall consists of a light-transmitting material.

28. The vessel of claim 1, particularly for use with containers for carbonated liquids, further comprising relief valve means arranged to open when the closure seals an open container and the pressure in such container rises above a predetermined value.

29. The vessel of claim 28, wherein said bottom comprises a bottom wall and said valve means is provided in said bottom wall.

30. The vessel of claim 29, wherein said valve means comprises a flap constituting an integral part of said bottom wall and a slit surrounding said flap.

31. The vessel of claim 29, wherein said valve means comprises a flap constituting an integral part of said bottom wall and a breakable connection between a portion of said flap and said bottom wall.

32. The vessel of claim 1, wherein said closure is arranged to seal the open end portion of a container which constitutes a bottle; and further comprising a second closure arranged to seal the open top of a can.

33. The vessel of claim 32, wherein said bottom comprises a bottom wall and said closures are provided in the region of said bottom wall.

34. The vessel of claim 33, wherein one of said closures is located in the interior and the other of said closures is located externally of said cup.

35. The vessel of claim 32, wherein said closures are located in the interior of said cup.

36. The vessel of claim 1, wherein said cup comprises a tubular wall having an open end constituting a rim and a second end constituting a leg for deposition of the cup on a supporting surface, said bottom comprising a bottom wall which is inwardly adjacent to said leg.

37. The vessel of claim 1 for use with a can having a top wall portion provided with an opening and a marginal portion surrounding said top wall portion, further comprising a second closure having at least one annular seal movable into and out of fluidtight engagement with at least one portion of the can.

38. The vessel of claim 37 for use with a can whose marginal portion has an external surface, wherein said cup comprises a tubular wall which surrounds the marginal portion when the cup is placed onto the can upside down, said annular seal including a portion of said tubular wall and being movable into fluidtight engagement with the external surface of the marginal portion of the can.

39. The vessel of claim 37 for use with a can whose top wall portion has a peripheral portion inwardly adjacent to the marginal portion of such can, wherein said cup has a bottom wall and said seal includes a portion of said bottom wall and is movable into fluidtight engagement with the peripheral portion of the top wall portion when the cup is placed onto the can upside down.

40. The vessel of claim 37, wherein said bottom comprises a bottom wall having an inner side and said second closure includes a projection provided at said inner side and receivable in the opening in the top wall portion of a can when the cup is placed onto such can upside down so that the top wall portion and the marginal portion of the can are confined in the interior of the cup.

41. The vessel of claim 37, wherein said bottom comprises a bottom wall and at least that portion of said bottom which includes said bottom wall consists of light-transmitting material.

42. The vessel of claim 37, wherein said cup includes a tubular wall having an open first end portion constituting the rim of said cup and a conical second end portion tapering inwardly in a direction away from said rim, said seal including the second end portion of said tubular wall and being arranged to sealingly surround the marginal portion of a can when the cup is placed over such can upside down so that the marginal portion and the top wall portion of the can are confined in the interior of the cup.

43. The vessel of claim 37, wherein said cup comprises at least one stop arranged to engage an adjacent part of a can when the cup is placed over the can upside down so that the top wall portion and the marginal portion of the can are confined in the interior of the cup whereby said stop determines the extent to which the cup confines the can.

44. The vessel of claim 43, wherein said bottom comprises a bottom wall and said stop is provided on said bottom wall.

45. The vessel of claim 44, wherein said seal is provided on said stop.

46. The vessel of claim 44, wherein said bottom wall has a concave inner side.

47. The vessel of claim 37 for use with a can whose marginal portion has a surface surrounding the top wall portion of such can, wherein said cup comprises a tubular wall having an open first end portion constituting a rim and a second end portion, said bottom comprising a bottom wall having a peripheral portion integral with the second end portion of said tubular wall, said peripheral portion constituting or including said seal and having an internal surface arranged to sealingly engage the surface of the marginal portion of the can over which the cup is placed in inverted position so that the marginal portion and the top wall portion of the can are confined in the interior of said cup.

48. The vessel of claim 47 for use with a can whose marginal portion has a conical surface tapering inwardly toward the bottom wall portion of such can, wherein said internal surface is a conical surface whose taper is complementary to that of the surface of the marginal portion of the can so that the internal surface is in pronounced fluidtight engagement with the conical surface of said marginal portion when the cup is placed over the can.

49. The vessel of claim 37, wherein said cup has a tubular wall having an open end portion constituting the rim of the cup and a second end portion, said bottom having a bottom wall extending transversely across said second end portion and said cup further having an inwardly extending annular protuberance connecting said bottom wall to said second end portion, said protuberance constituting said annular seal and abutting against at least one of the portions of the can when the cup is placed over the can upside down so that the marginal portion and the top wall portion of the can are concealed in the interior of the cup.

50. The vessel of claim 37 for use with a can whose marginal portion includes an outwardly extending bead, wherein said cup comprises a tubular wall having an internal shoulder for snap action engagement with said bead to hold the second closure in sealing engagement with the can when the cup is placed over the can so that the top wall portion and the marginal portion of the can are confined in the interior of the cup.

51. The vessel of claim 50, wherein said internal shoulder is a circumferentially complete shoulder and said annular seal bears against the top wall portion and/or the marginal portion of the can whose bead is engaged by such shoulder.

52. The vessel of claim 37, further comprising a relief valve arranged to open and thus permit a reduction of pressure in the interior of the can when the pressure in the interior of the can rises above a predetermined value.

53. The vessel of claim 52, wherein said valve includes a resilient valving element which tends to assume a sealing position.

54. The vessel of claim 52, wherein said seal is arranged to engage the top wall portion of the can.

55. The vessel of claim 52, wherein said cup comprises a tubular wall and said bottom includes a bottom wall, said seal including an annular portion connecting said bottom wall to said tubular wall, and said valve including said annular portion.

56. The vessel of claim 55, wherein said annular portion is elastic.

57. The vessel of claim 55, wherein said valve constitutes an annulus and said cup further comprises a weakened portion constituting part of said valve.

* * * * *